US006378746B1

(12) United States Patent
Miller

(10) Patent No.: US 6,378,746 B1
(45) Date of Patent: Apr. 30, 2002

(54) INFANT CARRIER SEAT SLING

(76) Inventor: Lois A. H. Miller, 320 S. Illinois St., Conrad, MT (US) 59425

( * ) Notice: Subject to any disclaimer, the term of this patent is extended or adjusted under 35 U.S.C. 154(b) by 0 days.

(21) Appl. No.: 09/703,180

(22) Filed: Oct. 31, 2000

(51) Int. Cl.[7] ..... A45F 3/14

(52) U.S. Cl. ..... 224/258; 224/264; 224/158; 224/604

(58) Field of Search ..... 224/158, 605, 224/258, 264, 257

(56) References Cited

U.S. PATENT DOCUMENTS 4,487,346 A * 12/1984 Fischer, Jr ..... 224/160
4,644,902 A * 2/1987 Doyle ..... 119/497
5,083,692 A * 1/1992 Treese ..... 224/250
5,238,162 A * 8/1993 LaCivita ..... 206/315.9
5,246,154 A * 9/1993 Adams et al. ..... 224/150
5,267,680 A * 12/1993 Torok ..... 224/158
5,318,209 A * 6/1994 Rader et al. ..... 224/250
5,540,365 A * 7/1996 LaMair ..... 224/158
5,632,425 A 5/1997 Hull
5,791,535 A 8/1998 Roan et al.
5,813,580 A 9/1998 Fair
5,927,576 A 7/1999 Nielsen

* cited by examiner

*Primary Examiner*—Stephen K. Cronin
(74) *Attorney, Agent, or Firm*—Henderson & Sturm LLP

(57) ABSTRACT

A sling for transporting a conventional infant carrier seat having a generally rigid body provided with a pivoted carrier handle wherein the sling includes a sling member having a padded upper segment fabricated from a length of resilient material and having an elongated slot formed therein dimensioned to receive a main strap element adapted to define a first adjustable closed loop opening wherein the main strap element is further provided with an auxiliary strap element which cooperates with the main strap element to define a second adjustable closed loop opening that captively receives the handle of the conventional infant carrier seat

7 Claims, 2 Drawing Sheets

INFANT CARRIER SEAT SLING

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of specialized carrier or transport devices in general and in particular to a sling that attaches to the handle portion of a rigid infant carrier seat for transporting the carrier seat from one location to another.

2. Description of Related Art

As can be seen by reference to the following U.S. Pat. Nos. 5,927,576; 5,813,580; 5,791,535; and 5,632,425, the prior art is replete with myriad and diverse infant carrier slings designed to directly support and confine an infant in a safe and secure manner.

While all of the aforementioned prior art constructions are more than adequate for the basic purpose and function for which they have been specifically designed, they are uniformly deficient with respect to their failure to provide a simple, efficient, and practical means of transporting a generally rigid infant carrier seat from one location to another in a generally hands free manner.

As most users of infant carrier seats are all too well aware, the transport of the infant carrier seat by its existing handle can be a tiring and burdensome chore which forces the parent or guardian to switch the carrier seat from one hand to the other when traveling long distances.

In addition, the existing arrangement causes undue strain on the adult's arms and back, while also suspending the carrier seat where it can easily come into contact with the adults's legs thereby representing a potential danger to both the adult and to the infant within the carrier seat.

As a consequence of the foregoing situation, there has existed a longstanding need among parents and guardians of infants for a new and improved transport arrangement for infant carrier seats that allows the carrier seat to be suspended in a hands free fashion from the adult's upper torso; and, the provision of such an arrangement is the stated objective of the present invention.

BRIEF SUMMARY OF THE INVENTION

Briefly stated, the infant seat carrier sling that forms the basis of the present invention comprises a sling member having an upper padded section that is designed to be worn over a user's shoulder and a plurality of adjustable strap elements suspended from the upper padded section and adapted to engage the handle of a conventional rigid infant carrier seat.

As will be explained in greater detail further on in the specification, the sling member of this invention is adapted for use with virtually all generally rigid infant carrier seats equipped with a pivotable carrier handle wherein the carrier seat handle will be suspended from the sling member in a generally hands free fashion.

In addition, the plurality of strap elements includes a pair of strap elements suspended from one side of the upper padded section of the sling member and adapted to adjustably engage the opposite sides of a third strap element that is suspended from the other side of the upper padded section; wherein, one pair of cooperating strap elements defines an adjustable size loop that will encircle the upper portion of an adult's torso and the other pair of cooperating strap elements will dictate the height that the carrier seat handle will be suspended from the sling member.

BRIEF DESCRIPTION OF THE SEVERAL-VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
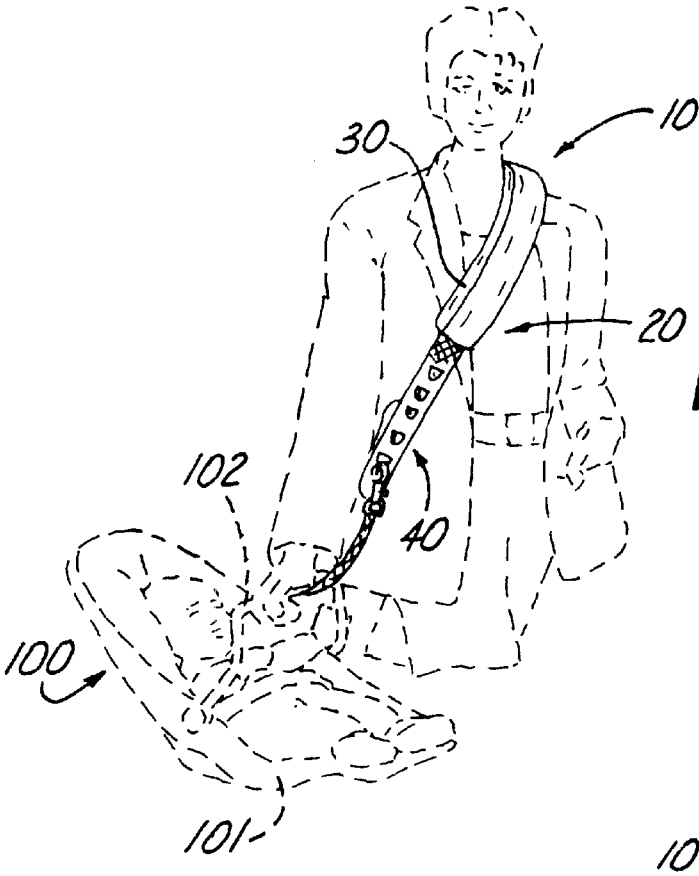
FIG. 1 is a perspective view of the sling worn across an adult's chest.
Figure 2:
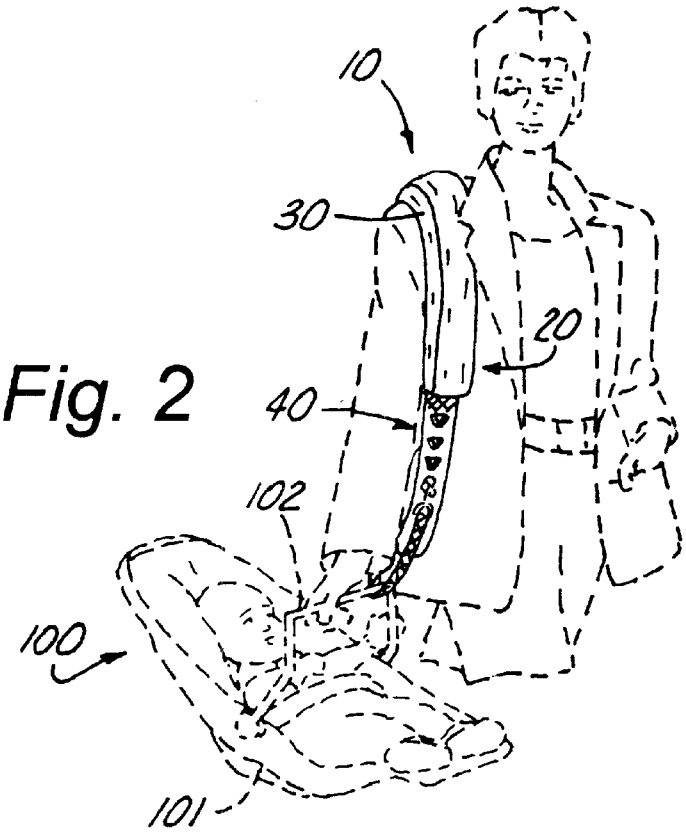
FIG. 2 is a perspective view of the sling member worn over an adult's shoulder.

As can be seen by reference to the drawings, and in particular to FIG. 1, the infant carrier seat sling that forms the basis of the present invention is designated generally by the reference number 10. The sling 10 comprises in general a sling member 20 having an upper padded segment 30 and a plurality of strap elements designated generally as 40 which are operatively associated with the upper padded segment 30 and which cooperate with one another and the upper padded segment 30 in a new and unique fashion.

Prior to embarking on a detailed description of the sling member 20, it would first be advisable to generally describe the infant carrier seat 100 with which this invention was specifically designed to be used. As shown in FIG. 1, a conventional infant carrier seat 100 has a generally rigid body 101 designed to support and confine an infant in a safe and secure manner and is routinely provided with a carrier handle 102 that is pivotally connected on opposite sides of the rigid body 101 proximate the midpoint thereof for transporting the carrier seat 100 from one location to another in a well recognized fashion. As can be seen by reference to FIGS. 3 and 4, the upper padded segment 30 of the sling member 20 comprises in general a length of resilient material 31 such as foam rubber or the like having a slot running the entire length of the upper segment 30 wherein the purpose and function of the slot 32 will be explained presently.

Figure 3:
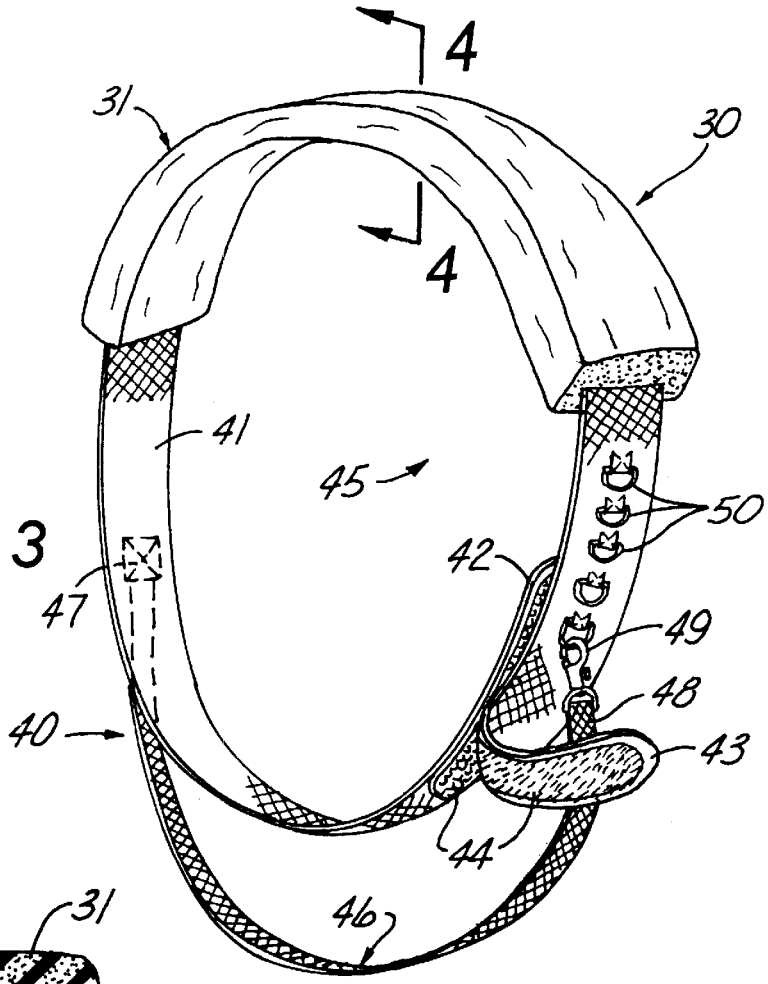
FIG. 3 is an isolated perspective view of the sling.
Figure 4:
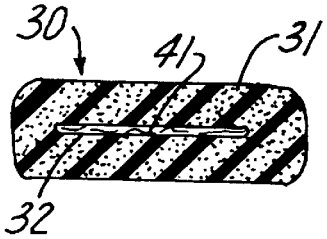
FIG. 4 is a cross-sectional view taken through line 4—4 of FIG. 3; and, FIG. 5 is an isolated detail view of the captive engagement between the auxiliary strap element and the main strap element.

In the preferred embodiment of the invention depicted in FIG. 3, it can be seen that the plurality of strap elements which are designated generally as 40 include an elongated relatively wide main strap element 41 which is dimensioned to be fixedly received within the slot 32 in the upper padded segment 30 of the sling member 20 and to extend a substantial distance beyond the ends of the upper padded segment 30.

In addition, the opposite ends 42 43 of the main strap element 41 are provided with cooperating hook and loop fasteners 44 whereby the size of the closed loop opening 45 formed by the main strap element 41 may be varied to accommodate the upper torso specifically including the chest and shoulder area of different sized adults.

Figure 5:
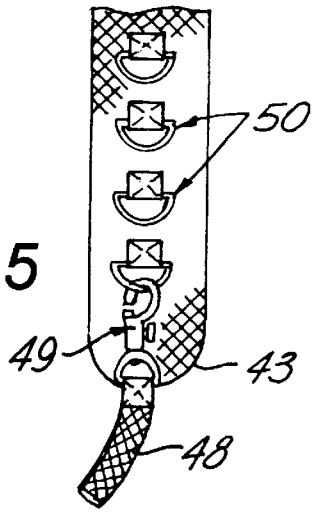

As can also be seen by reference to FIGS. 3 and 5, the plurality of strap elements 40 further includes an auxiliary strap element 46 having one end 47 fixedly secured to one end 42 of the main strap element 41; wherein, the other end 48 of the auxiliary strap element 46 is provided with a fastening element 49 that is adapted to selectively engage one of a plurality of cooperating fastening elements 50 provided on the other end 43 of the main strap element 41 to vary the height that the handle 102 of the carrier seat 100 will be suspended from the main strap element 41 and by extension of the upper torso of an adult wearing the sling member.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A sling for a conventional infant carrier seat having a generally rigid body provided with a pivoted carrier handle wherein the sling comprises:

a sling member having a padded upper segment fabricated from a length of padded material;

means associated with the padded upper segment of the sling member for defining an adjustable closed loop opening that captively receives the carrier handle of the conventional infant carrier;

a plurality of strap elements including a main strap element having opposite ends associated with the padded upper segment and provided with cooperating fasteners wherein the main strap element in cooperation with the padded upper segment of the strap member defines an adjustable closed loop opening; and an auxiliary strap element having one end fixedly secured to one of the opposite ends of the main strap element and having another end that is releasably connected to the other of the opposite ends of the main strap element.

2. The sling as in claim 1, wherein, the auxiliary strap element and the main strap element are adapted to define an adjustable closed loop opening.

3. The sling as in claim 1, wherein, the padded upper segment of the sling member is provided with an elongated slot running the length of said padded upper segment and dimensioned to receive said main strap element.

4. The sling as in claim 1, wherein said main strap element is an elongated strap element affixed to the padded upper segment of the sling member and having opposite ends Which project beyond the padded upper segment of the sling member.

5. The sling as in claim 4, wherein, the padded upper segment of the sling member is provided with an elongated slot running the length of said padded upper segment and dimensioned to receive said main strap element.

6. A sling for a conventional infant carrier scat having a generally rigid body provided with a pivoted carrier handle; wherein, the sling comprises:

a sling member having an upper padded segment and a plurality of strap elements including a main strap element fixedly secured to said upper padded segment and adapted to define a first adjustable closed loop opening;

wherein said plurality of strap elements further includes an auxiliary strap element fixedly secured on one end and releasably secured on another end to said main strap element.

7. The sling as in claim 6, wherein, said auxiliary strap clement is adapted to cooperate with said main strap element to define a second adjustable closed loop opening that is dimensioned to receive the handle of said conventional infant carrier seat.

* * * * *